US007448956B2

(12) United States Patent
Mitchell

(10) Patent No.: US 7,448,956 B2
(45) Date of Patent: Nov. 11, 2008

(54) SWING PLANE INDICATING GOLF MAT

(75) Inventor: Jeffery R. Mitchell, Tallahassee, FL (US)

(73) Assignee: Growth Innovations, LC, Tallahassee, FL (US)

( * ) Notice: Subject to any disclaimer, the term of this patent is extended or adjusted under 35 U.S.C. 154(b) by 0 days.

(21) Appl. No.: 11/707,585

(22) Filed: Feb. 16, 2007

(65) Prior Publication Data

US 2008/0200277 A1 Aug. 21, 2008

(51) Int. Cl.
*A63B 69/36* (2006.01)

(52) U.S. Cl. ..... 473/278; 473/279

(58) Field of Classification Search ..... 473/262, 473/278, 279, 219, 257, 218
See application file for complete search history.

(56) References Cited

U.S. PATENT DOCUMENTS

| | | | | |
|---|---|---|---|---|
| 2,152,381 | A | 3/1939 | Harpster | |
| 3,018,109 | A | 1/1962 | Starck | |
| 3,107,920 | A | 10/1963 | Strunk | |
| 3,113,780 | A | 12/1963 | Livingstone | |
| 3,717,349 | A * | 2/1973 | Bohnen | 473/262 |
| 3,815,923 | A * | 6/1974 | Goduto | 473/262 |
| 4,786,057 | A | 11/1988 | Brown | |
| 5,354,064 | A | 10/1994 | Toikka | |
| 5,513,842 | A | 5/1996 | Fuss | |
| 6,740,387 | B1 * | 5/2004 | Lemieux | 428/95 |
| 6,786,833 | B2 | 9/2004 | Ahrend | |
| 2004/0253390 | A1 * | 12/2004 | Trafford | 428/17 |

* cited by examiner

*Primary Examiner*—Nini Legesse
(74) *Attorney, Agent, or Firm*—J. Wiley Horton

(57) ABSTRACT

A swing plane indicating golf mat capable of indicating the path of a swing through the critical zone. The golf mat includes an array of toggling, grass-mimicking blades which, from the vantage point of the golfer, assume a different appearance when toggled over. In the preferred embodiment, the blades have a forward face and a rearward face. The forward face and rearward face are different colors. Because of the curvature of the blades, the blades normally appear one color when the blades are in their normal and non-toggled position. When the blades are toggled, the blades appear a different color.

12 Claims, 8 Drawing Sheets

SWING PLANE INDICATING GOLF MAT

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of golf swing aids. More specifically the present invention comprises a swing plane indicating golf mat for diagnosing and correcting out-of-plane golf swings.

2. Description of the Related Art

Many prior art golf aids are intended to correct problems in a golfer's swing. The majority of these golf aids are directed to diagnosing and/or correcting an "out-of-plane" swing. A swing that is out-of-plane typically causes the actual trajectory of a golf ball to deviate from the intended trajectory. An extreme deviation in trajectory caused by opening the club face relative to the point of impact is often referred to as a "slice." The extreme deviation in trajectory caused by closing the club face relative to the point of impact is often referred to as a "hook." A moderate (yet significant) deviation in trajectory may also be produced when a swing is out of alignment even if the club face strikes the ball in a perpendicular direction with respect to the target. This type of deviation is often referred to as a "push" or "pull" depending upon the direction of the misalignment.

Experienced golfers and trainers typically correct a golfer's swing by (1) comparing the golfer's swing to an idealized swing "plane," and (2) implementing corrections and adjustments that bring the golfer's swing motion into alignment with the idealized swing plane. Those that are skilled in the art know that this process of swing improvement continues throughout the life of the golfer.

Although the entire swing motion is important, the trajectory of a golf ball is most affected by the motion of the swing in a critical zone. The critical zone encompasses the motion of the swing just before, during, and immediately after impact with the golf ball. It is also within this critical zone that misalignments occurring earlier or later in the swing motion tend to manifest. It is during this critical zone that contact with the ball is initiated and the ball releases from the club face. Accordingly, the motion of the club face through this critical zone affects the magnitude and direction of the force imparted to the ball. The motion of the club face in this critical zone also affects the spin imparted to the ball from the angle of the club face.

Although many useful golf aids exist for diagnosing and/or correcting misalignments in a golfer's swing, most golf aids do not provide adequate feedback regarding the motion of a golfer's swing through the critical zone. Accordingly, it would be beneficial to provide a golf aid which helps a golfer diagnose and correct swing misalignment through the critical zone.

BRIEF SUMMARY OF THE INVENTION

The present invention comprises a swing plane indicating golf mat capable of indicating the path of a swing through the critical zone. The golf mat includes an array of toggling, grass-mimicking blades which, from the vantage point of the golfer, assume a different appearance when "toggled over." The grass-mimicking blades are capable of transitioning between two stable states. The impact of the club face striking the blades causes the struck blades to toggle from one state to the other.

In the preferred embodiment, the blades have a forward face and a rearward face. The forward face and rearward face are different colors (for example green and brown). Because of the curvature of the blades, the blades normally appear one color (such as green) when the blades are in their normal position. When the blades are toggled over, the blades appear a different color (such as brown).

A proposed structure for such an toggling blade is also provided. The blade generally includes a pair of outer pillars and a center pillar. The outer pillars and center pillar each extend from the base of the blade and join together at the top of the blade. A flexible membrane spans between and connects the pillars.

REFERENCE NUMERALS IN THE DRAWINGS

| | | | |
|---|---|---|---|
| 10 | blade | 12 | tip |
| 14 | base | 16 | outer pillar |
| 18 | center pillar | 20 | rigid section |
| 22 | flexible section | 24 | membrane |
| 26 | series | 28 | top portion |
| 30 | rearward face | 32 | forward face |
| 34 | top portion | 36 | normal blade |
| 38 | toggled blades | 40 | demarcation line |
| 42 | mat | 44 | feet position |
| 46 | toggled blades | 48 | normal blades |
| 50 | demarcation line | | |

DETAILED DESCRIPTION OF THE INVENTION

Figure 1:
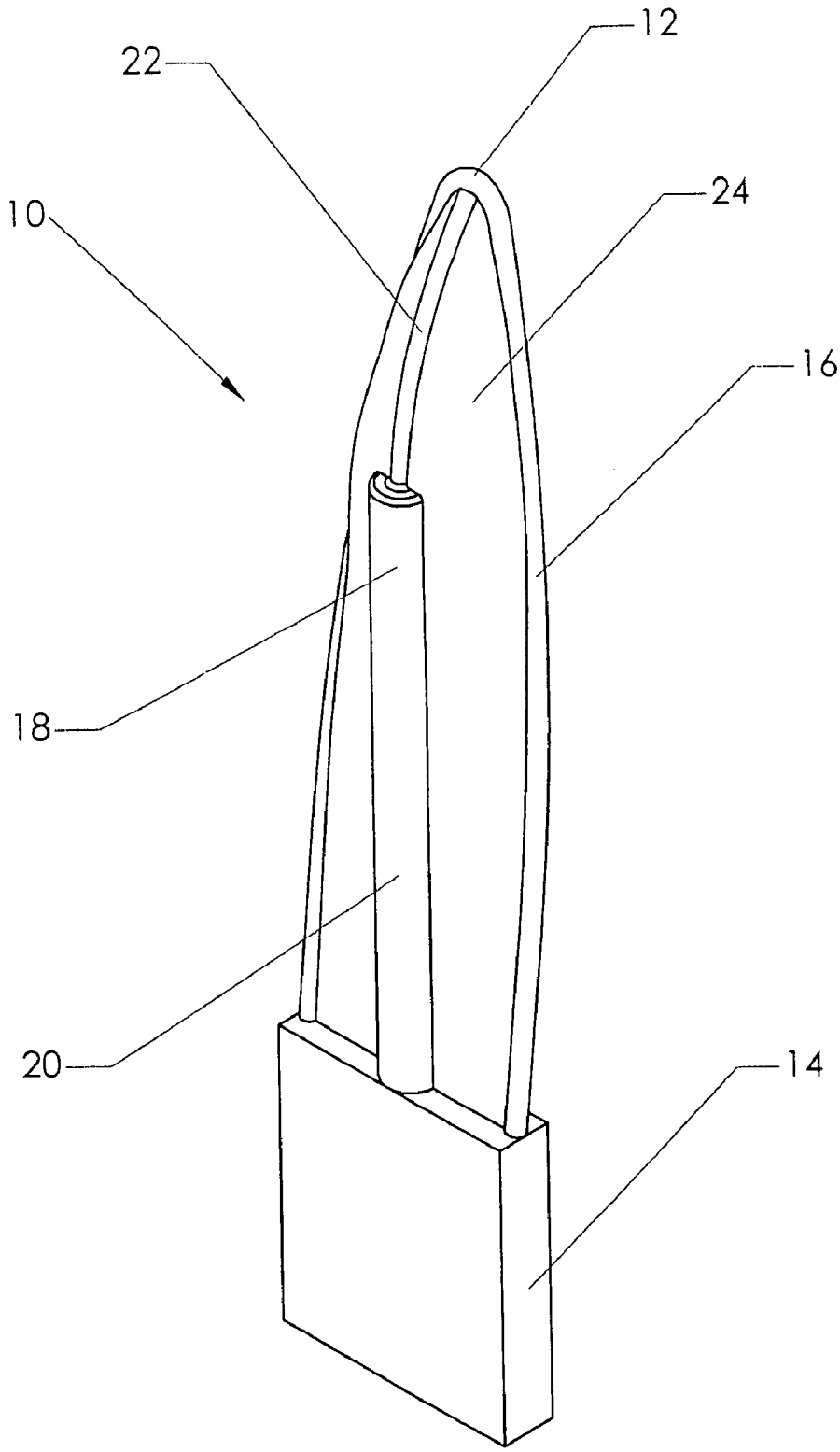
FIG. 1 is a perspective view, showing a toggling, grass-mimicking blade.
Figure 2:
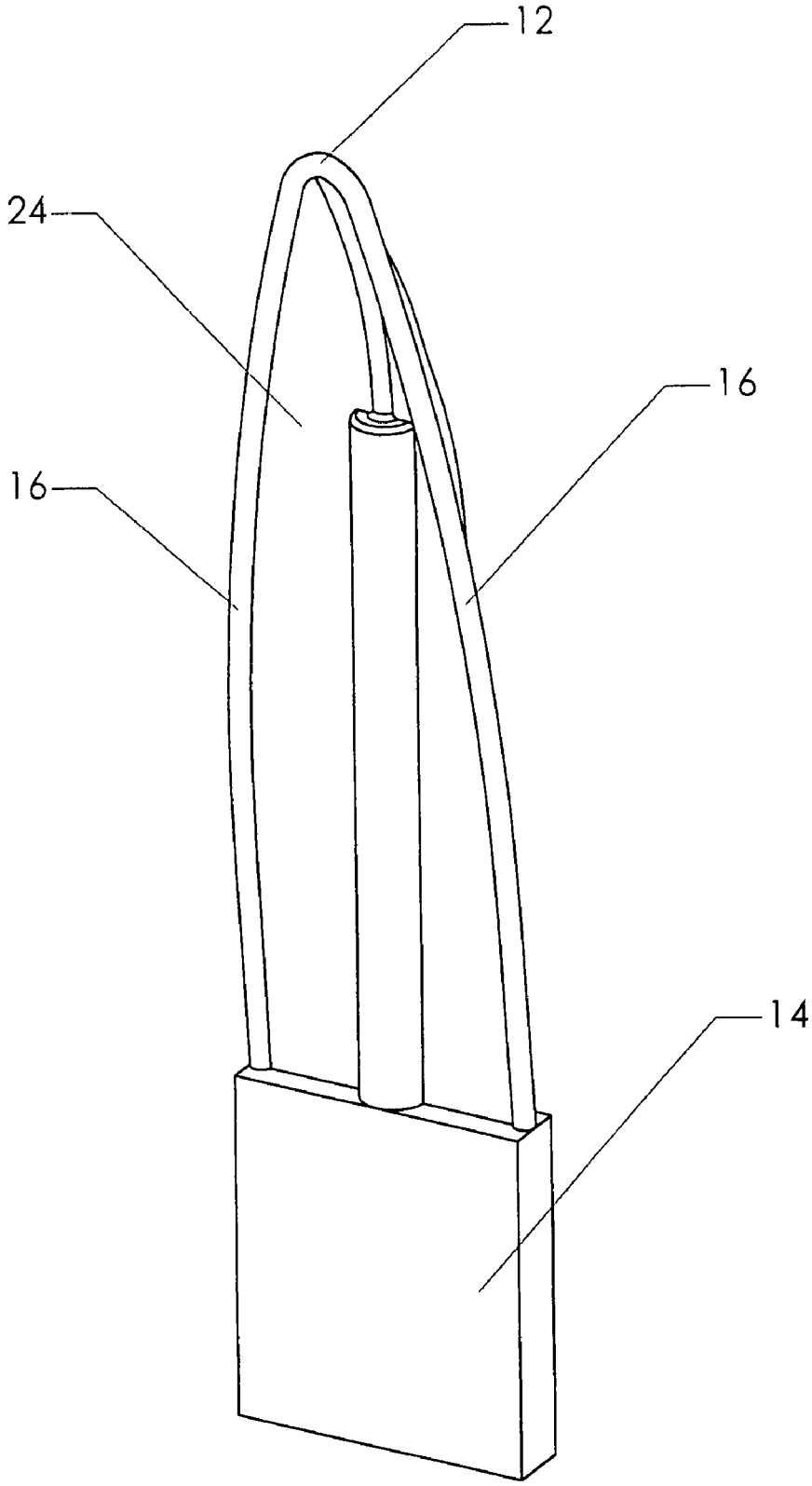
FIG. 2 is a perspective view, showing a toggling, grass-mimicking blade.

A grass-mimicking, toggling blade is illustrated in FIGS. 1 and 2. FIG. 1 shows the rearward-facing face of blade 10, and FIG. 2 shows the forward-facing face of blade 10. Blade 10 includes two outer pillars 16 and center pillar 18 extending from base 14 and joining at tip 12. Membrane 24 spans between and connects outer pillars 16 and center pillar 18. Center pillar 18 has two portions—flexible section 22 proximate to tip 12 and rigid section 20 proximate to base 22. Center pillar 18 and outer pillars 16 provide structural support to blade 10, keeping blade 10 erect even when a relatively small force is exerted downward on tip 12. They also interact with each other in such a way that blade 10 is capable of transitioning back and forth between a normal and toggled over position as will be described in greater detail subsequently.

Blade 10 is preferably constructed of a flexible and durable material. Blade 10 may be constructed using various processes and components which would be commonly known to one skilled in the art. For example, blade 10 may be injection molded using different mixtures of thermoplastic elastomers (such as a thermoplastic polyurethane elastomer) and/or melt-processible rubber. Other materials and manufacturing techniques may also be used. It is generally preferred for center pillar 18 to be stiffer than membrane 24 and outer pillars 16. This can be accomplished by injecting the center pillar portion of the mold cavity with a slightly firmer mixture of whichever polymer is injected into the outer pillar injection points. The firmer formulation and softer formulation will run together at the tip portion of the mold cavity.

Figure 3:
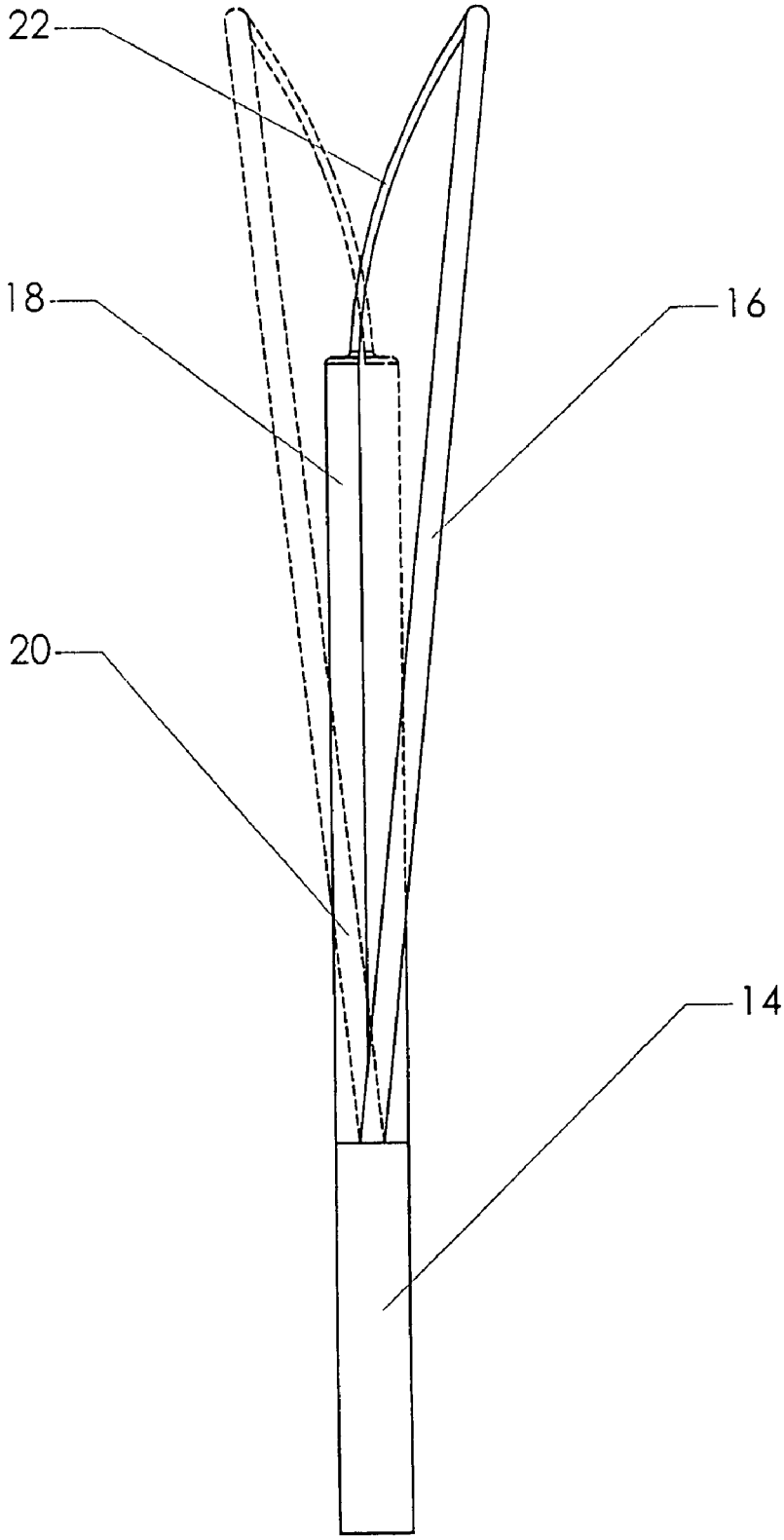
FIG. 3 is a side view, showing a toggling, grass-mimicking blade.

FIG. 3 shows the grass-mimicking blade from the side. The reader will note that rigid portion 20 of center pillar 18 extends vertically above base 14. Outer pillar 16 leans forward slightly (to the right in the drawing) when in the normal orientation as shown. Outer pillar 16 and rigid portion 20 center pillar 18 exert a compressive force on flexible portion 22. When the blade is struck by a club face (moving from right to left in the figure), the force of the club striking the tip of the blade causes flexible portion 22 to buckle. When struck in this manner, the blade is toggled over. The toggled over position appears as a mirror image of the normal position from the side. In the toggled over position (shown with "ghost" lines), center pillar 18 continues to extend vertically from base 14 and outer pillar 16 leans the opposite direction. Flexible portion 22 is again subjected to compressive forces by outer pillar 16 and rigid portion 20 of center pillar 18.

Figure 4:
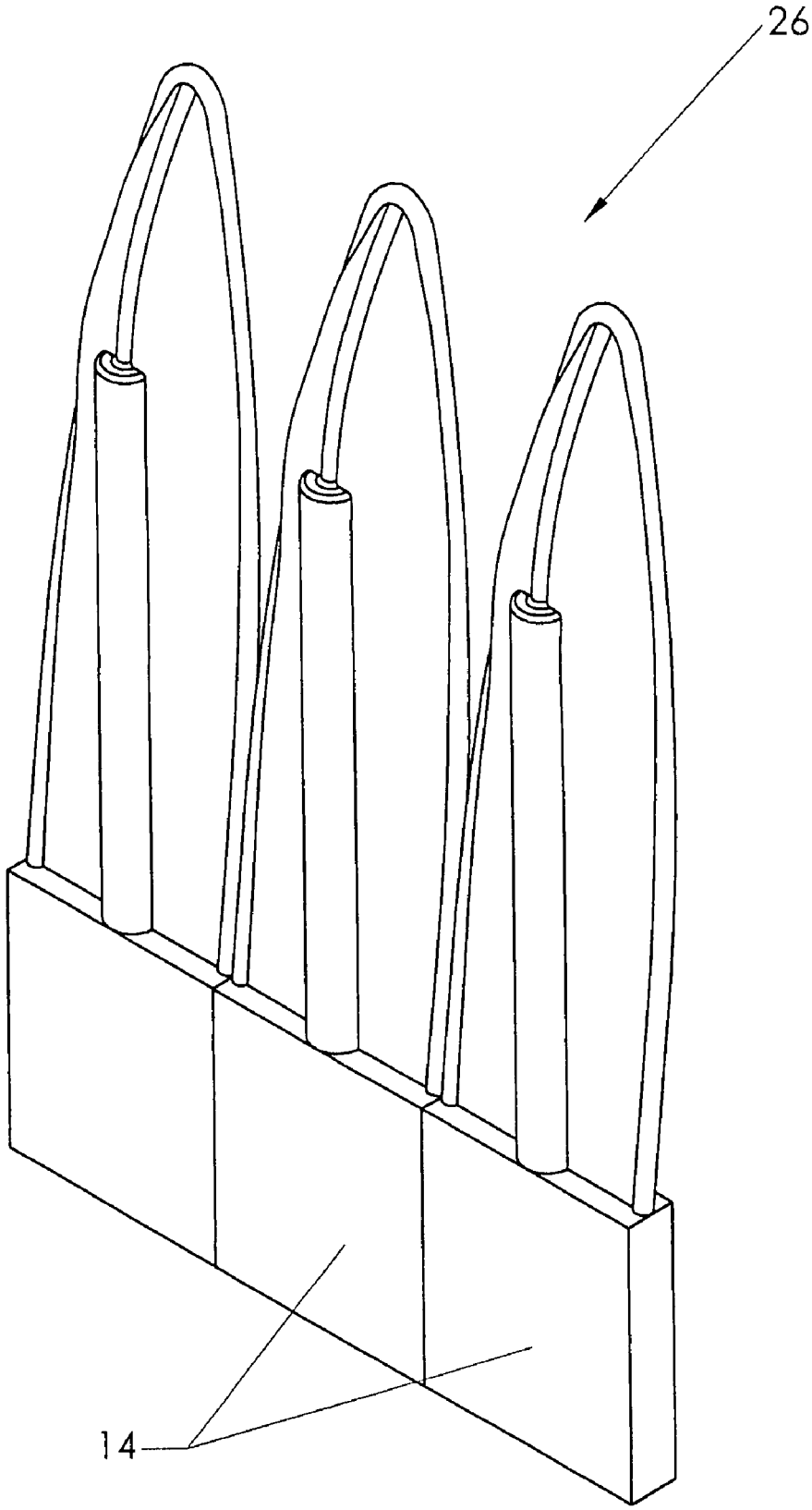
FIG. 4 is a perspective view, showing a series of toggling, grass-mimicking blades.

As illustrated in FIG. 4, the grass-mimicking blades may be manufactured in strips similar to series 26. Bases 14 may be formed together during the molding process (the base portions of the cavities may be fluidly connected) or the bases may be thermally fused together after the fabrication of the individual blades. These strips may then be thermally fused together at the base to form an array of blades as illustrated in FIGS. 5-7.

Figure 5:
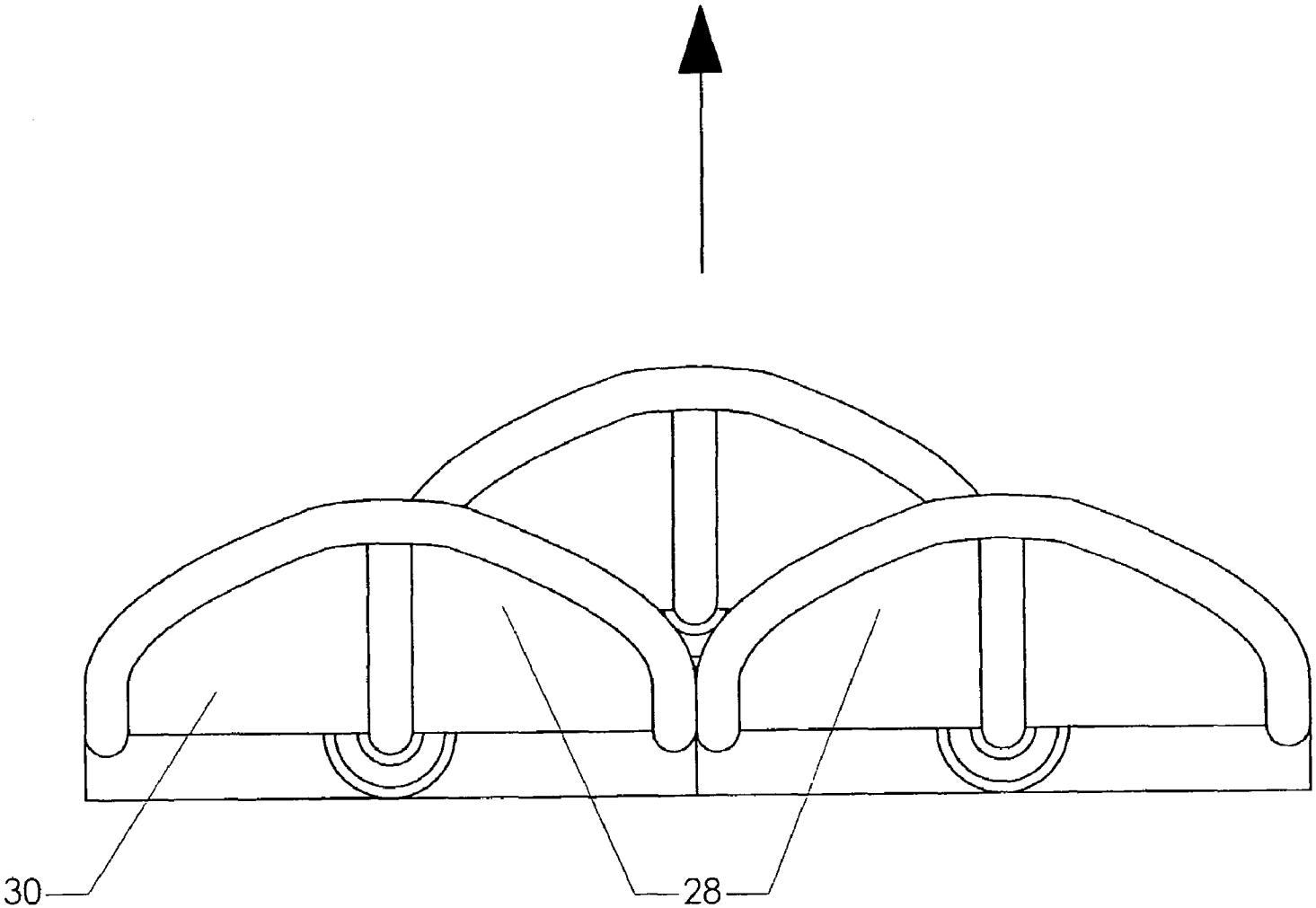
FIG. 5 is a top view, showing an array of blades in the toggled over position as would be seen from the perspective of a golfer.

FIG. 5 shows an array of blades in the toggled over position as would be seen from the perspective of a golfer looking downward at the training mat. The arrow indicates the direction of the target relative to the training mat. When in the toggled over position, top portion 28 of rearward face 30 is seen by the golfer.

Figure 6:
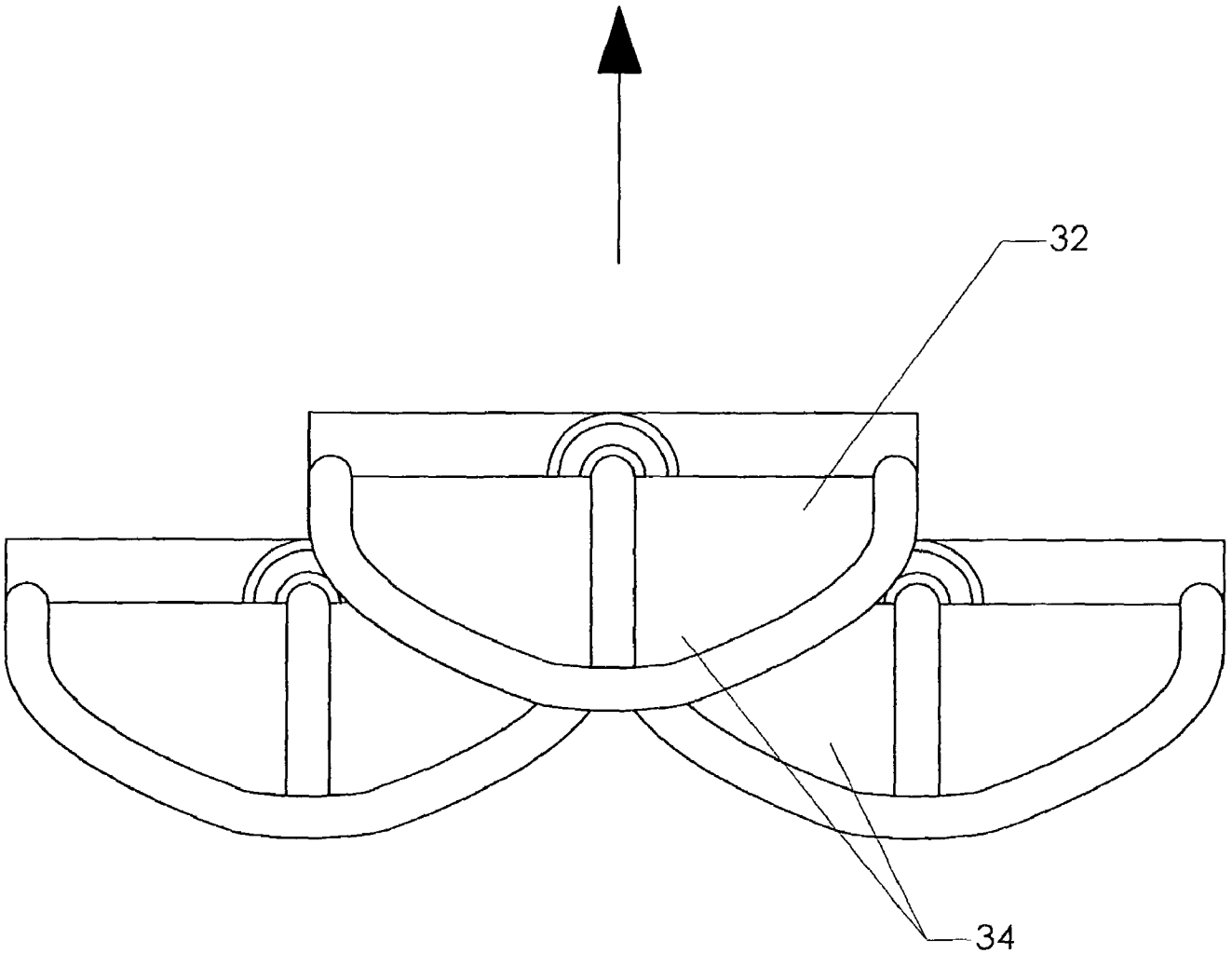
FIG. 6 is a top view, showing an array of blades in the normal position as would be seen from the perspective of a golfer.
Figure 7:
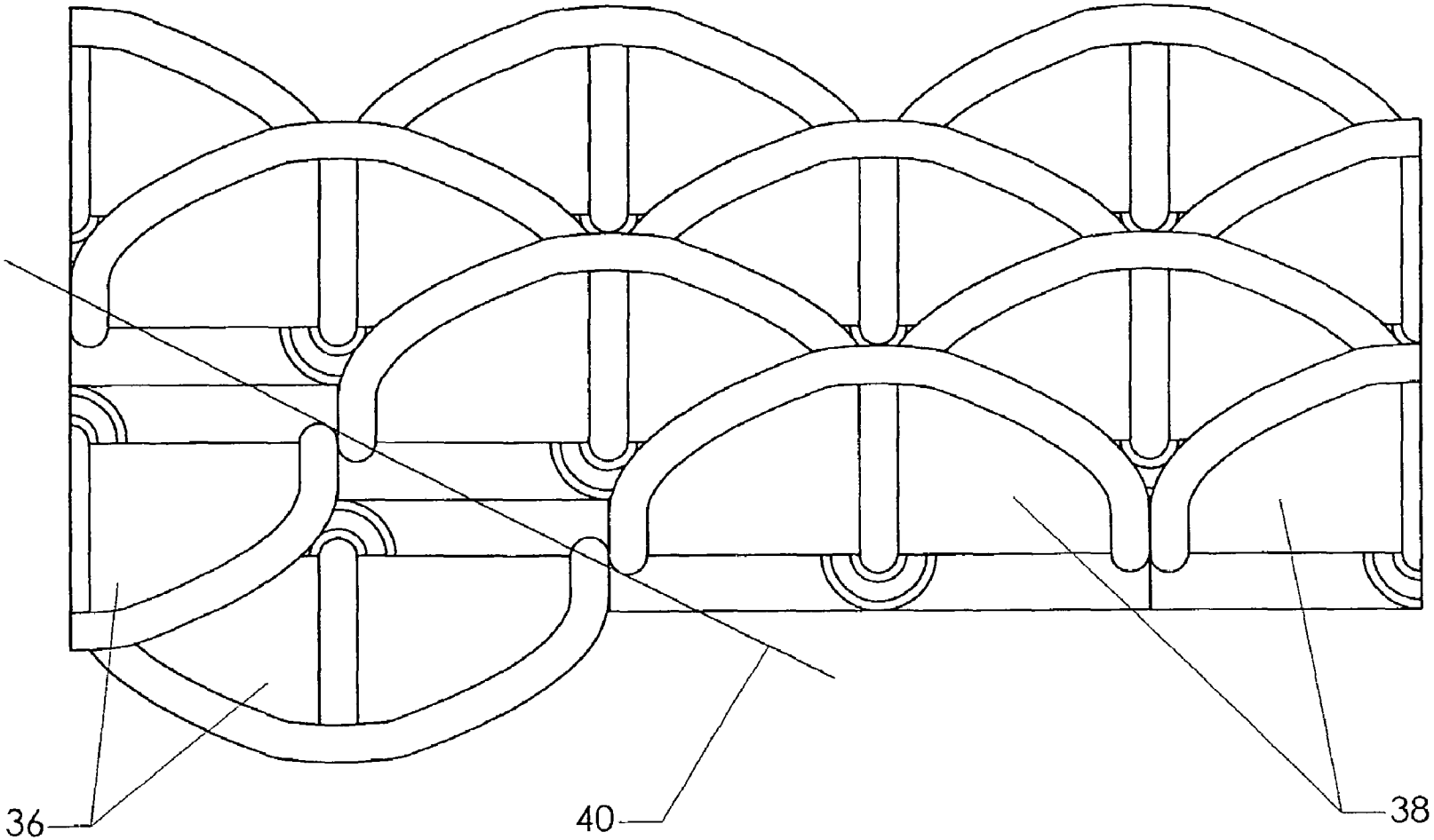
FIG. 7 is a top view, showing an array of blades in different positions.

FIG. 6 shows the same array of blades of FIG. 5 with the blades in their normal position. Once again an arrow is provided to indicate the direction of the target relative to the training mat. When in the normal position, top portion 34 of forward face 32 is seen by the golfer. For the purposes of the present invention, it is important for forward face 32 and rearward face 30 to appear different from each other from the vantage point of the golfer. One way to accomplish this is with the use of color. In the preferred embodiment, forward face 32 is green and rearward face 30 is brown. This color scheme simulates the appearance of natural grass before the golfer swings the club face through the grass. When the club face swings through the grass (toggling the struck blades to the toggled over position), the struck blades will appear brown simulating a divot. The golfer then rakes the club face backwards through the portion of the mat with the toggled blades to reset the blades to the normal, non-toggled position.

There are many ways that color may be imparted to the blades of grass. Color may be imparted during the molding process with dyes or it may be applied to the forward and rearward faces of the blades after fabrication of the blades.

By now, the reader should understand how such a training mat may be used to diagnose and correct misalignment of a golf swing. The golfer or trainer simply needs to look at the simulated divot to determine the motion of the golfer's swing through the critical zone. This is because all of the blades that are contacted by the face of the club will be toggled over. As shown in FIG. 7, a readily apparent demarcation line 40 appears between normal blades 36 and toggled blades 38. In the present example, demarcation line 40 slants from right to left relative to the forward motion of the swing, indicating a misalignment of the swing plane from the idealized plane. For a right-handed golfer, this type of demarcation line is indicative of a slice-producing swing. In the present illustration, the angle of demarcation line 40 is exaggerated for illustration purposes. Skilled trainers and golfers may ascertain even more information about the golfer's swing when examining the shape and location of simulated divot. For example, the shape of the simulated divot will tell the golfer or trainer about club face entry and exit angles. The location of the simulated divot may convey information to the trainer or golfer about whether the golf is addressing the golf ball correctly in his or her stance.

The reader will note that the drawings views provided herein are dramatically enlarged to show the details of the present invention. In the preferred embodiment, the blades of grass are similar in size to natural grass. Thus, the training mat preferably contains hundreds to thousands of individual blades. The proposed training mat may be used in conjunction with actual ball-striking practice or the user may elect to use the mat without a golf ball.

Figure 8:
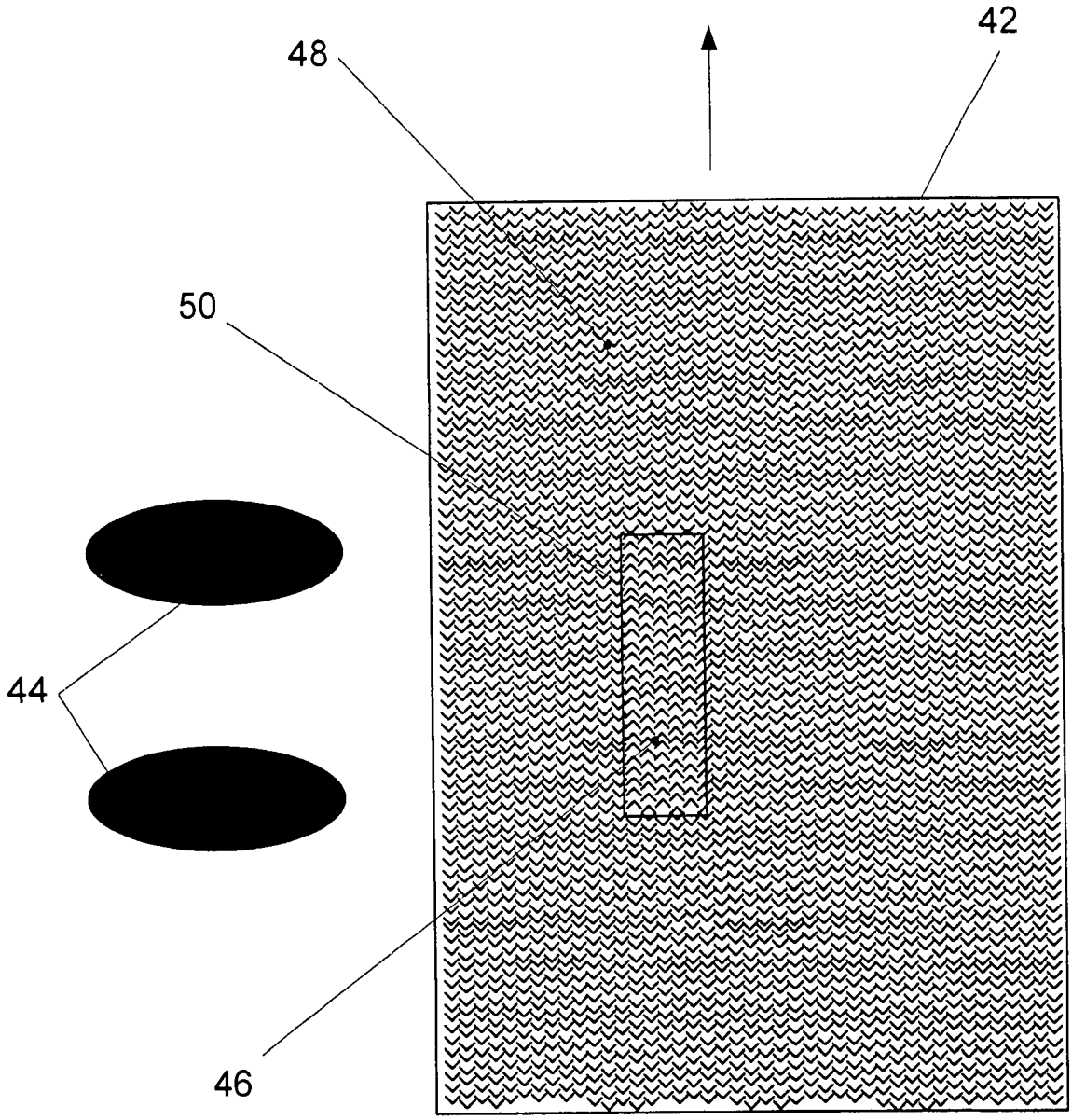
FIG. 8 is a global view, showing how the proposed golf mat may be used to determine the path of the club face through the critical zone.

FIG. 8 shows a representation of the proposed golf mat after a golfer has swung a club face through the blades. Feet position 44 indicate where the golfer stands when addressing golf mat 42. An arrow is provided to indicate the direction of the target. Blades that were not struck by the golf club remain in their normal position as indicated by the region of normal blades 48. Blades that were struck by the golf club are toggled as indicated by the region of toggled blades 46. Demarcation line 50 illustrates the boundary of toggled blades 46 and the shape of the simulated divot.

The preceding description contains significant detail regarding the novel aspects of the present invention. It should not be construed, however, as limiting the scope of the invention but rather as providing illustrations of the preferred embodiments of the invention. As an example, many different blades may be constructed having similar properties as the blades of the current invention. For example, toggling, grass-mimicking blades may have structures that differ from the preferred embodiment illustrated herein. Such variations would not alter the function of the invention. Thus, the scope of the invention should be fixed by the following claims, rather than by the examples given.

The invention claimed is:

1. A training mat configured to indicate the path of a club face swung through the critical zone by a golfer, said training mat comprising:

a. an array of grass-mimicking blades, each of said grass-mimicking blades positionable in a first stable state and a second stable state; each of said grass mimicking blades having i. a base, ii. a tip, iii. a first outer pillar, a second outer pillar, and a center pillar, each of said first outer pillar, said second outer pillar, and said center pillar extending from said base and joining at said tip; and iv. a membrane spanning between and connecting said first outer pillar, said second outer pillar and said center pillar from said base to said tip;

b. wherein said grass-mimicking blades toggle from said first stable state to said second stable state when struck by said club face; and c. wherein said second stable state is visually distinguishable from said first stable state when viewed from above.

2. The training mat of claim 1, wherein each of said grass-mimicking blades has a forward-facing face and a rearward-facing face, and wherein said rearward-facing face is a different color than said forward-facing face.

3. The training mat of claim 2, wherein said rearward-facing face is green and said forward-facing face is brown.

4. The training mat of claim 1, wherein said membrane comprises a thermoplastic elastomer.

5. The training mat of claim 1, wherein said center pillar comprises a more rigid material than said membrane.

6. The training mat of claim 1, wherein said center pillar comprises a rigid section proximate said base and a flexible section proximate said tip, said flexible section more pliable than said rigid section.

7. The training mat of claim 6, wherein said flexible section is configured to buckle when struck by said club face.

8. The training mat of claim 1, wherein said array of grass-mimicking blades are attached together at said base.

9. The training mat of claim 1, wherein said center pillar is configured to buckle when struck by said club face.

10. The training mat of claim 1, wherein said blades remain in said second stable state after said blades are struck by said club face until said blades are reset by dragging said club face over said blades in the opposite direction of said golfer's swing.

11. The training mat of claim 1, wherein said center pillar is more rigid than said membrane.

12. The training mat of claim 1, wherein said first outer pillar and said second outer pillar are configured to hold each of said grass-mimicking blades in one of said first stable state and said second stable state by exerting a tensile force on said membrane.

* * * * *